United States Patent [19]

Pehr

[11] 4,401,227

[45] Aug. 30, 1983

[54] TAMPER INDICATING CLOSURE CAP

[76] Inventor: Harold T. Pehr, 3920 W. 96th St., Overland Park, Kans. 66207

[21] Appl. No.: 293,158

[22] Filed: Aug. 17, 1981

[51] Int. Cl.[3] ..... B65D 41/34

[52] U.S. Cl. ..... 215/252

[58] Field of Search ..... 215/252, 253

[56] References Cited

U.S. PATENT DOCUMENTS

| | | | |
|---|---|---|---|
| 2,698,108 | 12/1954 | Schwartz . | |
| 3,231,123 | 1/1966 | Heierle | 215/253 X |
| 3,484,012 | 12/1969 | White et al. . | |
| 3,673,761 | 7/1972 | Leitz . | |
| 3,737,064 | 6/1973 | Patel et al. . | |
| 3,805,987 | 4/1974 | Horvath . | |
| 4,190,169 | 2/1980 | Pehr | 215/252 |
| 4,308,969 | 1/1982 | Heisler et al. | 215/253 X |

*Primary Examiner*—Donald F. Norton

*Attorney, Agent, or Firm*—Litman, Day & McMahon

[57] ABSTRACT

An integrally formed tamper indicating closure cap for use on a container having a locking shoulder on a neck thereof includes a top wall with a peripheral skirt depending therefrom. Positioned within slots formed in the skirt are tamper tabs having inwardly projecting lugs which engage the shoulder during removal of the cap from the container to thereby cause at least partial separation of the tabs from the cap so as to indicate that the container has been opened. In modified forms of the cap, the cap is manufactured with the lugs in outwardly projecting positions, the lugs subsequently being folded and locked into the inwardly projecting positions.

14 Claims, 13 Drawing Figures

TAMPER INDICATING CLOSURE CAP

FIELD OF THE INVENTION

The present invention relates to tamper indicating packages and, more particularly, to a container closure cap having tamper tabs which are rupturably displaced upon removal of the cap from the container.

DESCRIPTION OF THE PRIOR ART

In the field of packaging, many products are placed in containers which are sealed by means of screw-off type closure caps. In order to assure a purchaser that the package has not been previously opened, tamper indicating closures have been developed wherein portions of the closure are connected to a skirt or the like thereof by means of weakened portions or bridges. Such portions engage with a locking shoulder of the container such that when the cap is screwed off for opening, the linear movement of the cap causes the bridges to break or tear, separating the locking portion from the remainder of the cap, permitting the cap to be removed, and further, indicating that the container has been opened. When the locking portion is in the form of a ring which remains on the neck of the container, difficulties are presented in reuse of the container or recycling thereof.

SUMMARY OF THE INVENTION

The present invention overcomes such difficulties by providing a closure cap having tamper tabs which are at least partially torn loose upon removal of the cap from the container to indicate unauthorized opening thereof and which may be torn completely loose and discarded by a purchaser of a product so packaged.

OBJECTS OF THE INVENTION

The principal objects of the present invention are: to provide an improved tamper indicating closure cap; to provide such a closure cap which is of a screw-off type or snap-off type for use on a container having a locking shoulder thereon; to provide such a closure cap having one or more tamper tabs rupturably connected thereto with inwardly projecting lugs which engage the locking shoulder upon removal of the cap from the container to thereby tear loose the tab to indicate that the container has been opened; to provide such a closure cap wherein the ruptured tabs can be fully removed for discarding whereby a container sealed thereby may more easily be recycled or reused; to provide such a closure cap wherein, once the container has been opened, the tamper indicators may not be easily replaced or repaired to disguise such an opening; to provide such a closure cap which effectively seals the container with which same is used, even after the initial opening thereof; to provide such a closure cap which may be molded as an integral structure from plastic; and to provide such a tamper indicating closure cap which is economical to manufacture, convenient in use, positive in operation, and which is particularly well adapted for the intended purpose thereof.

Other objects and advantages of the present invention will become apparent from the following description taken in connection with the accompanying drawings wherein are set forth, by way of illustration and example, certain embodiments of this invention.

The drawings constitute a part of the specification, include an exemplary embodiment of the present invention, and illustrate various objects and features thereof.

DETAILED DESCRIPTION OF THE PREFERRED EMBODIMENTS

Figure 1:
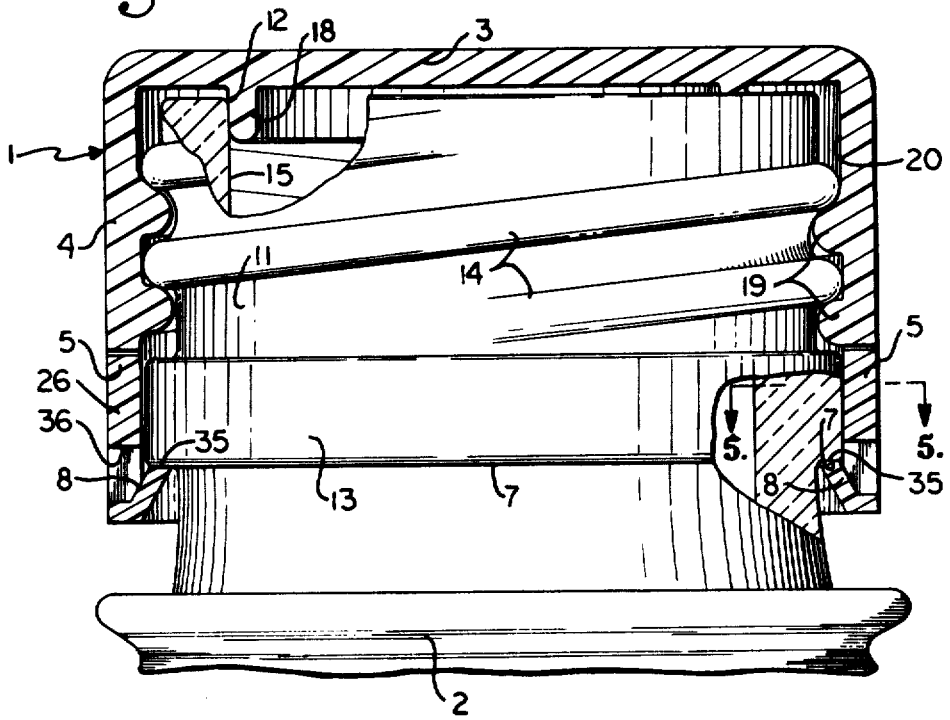
FIG. 1 is an enlarged vertical cross-sectional view of a tamper indicating closure cap according to the present invention shown in sealed relationship with the finish end of a container with portions broken away to show details thereof.

As required, detailed embodiments of the present invention are disclosed herein. However, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring to the drawings in more detail: The reference numeral 1 generally designates a tamper indicating closure cap for use on a container 2. The cap 1 includes a top wall 3 with a peripheral skirt 4 depending therefrom. The cap 1 is provided with at least one, preferably two, tamper tabs 5 positioned in slots 6 (FIG. 6) formed in the skirt 4. The container 2 is provided with a circumferential locking shoulder 7 for engagement by lugs 8 on the tamper tabs 5 during removal of the cap 1 from the container 2 to at least partially separate the tabs 5 from the cap 1 to thereby indicate that the container 2 has been opened.

The container 2, which may be a bottle, jar, or the like, is illustrated as having a necked portion or neck 11 with a mouth 12 formed at the end thereof. The neck 11 is provided with means such as a circumferential bead 13 which has the locking shoulder 7 formed on a lower side thereof. Preferably, the neck 11 is further provided with helical threads 14. The neck 11 includes an inner cylindrical surface 15 near the mouth 12 thereof. The container 2 may be formed of glass, plastic, metal, or any other suitable material.

The cap 1 includes sealing means to sealingly engage portions of the container 2 to retain materials packaged within the container 2. In the illustrated embodiment, the sealing means comprises a sealing annular structure or ring 18 which is provided on and depends from the top wall 3. The sealing ring 18 is sized and positioned to be received within the mouth 12 of the container in sealing engagement with the inner cylindrical surface 15 of the neck 11. The cap 1 is illustrated as having helical threads 19 on an inner surface 20 of the skirt 4 for mating and cooperating with the threads 14 on the container 2 to retain the cap 1 thereon. The threads 19 and 14, further, assist in separating the tabs 5 from the cap 1 as the cap 1 is unscrewed from the container 2. While the cap 1 and container 2 are illustrated as being threaded, such threads are not essential to the practice of the present invention. Thus, the cap 1 with tamper taps 5 would be useful in a snap-on/snap-off type of arrangement wherein such a cap and container would include interior and exterior rings respectively which may be forced to slide past one another but would tend to hold the cap on the container.

Figure 4:
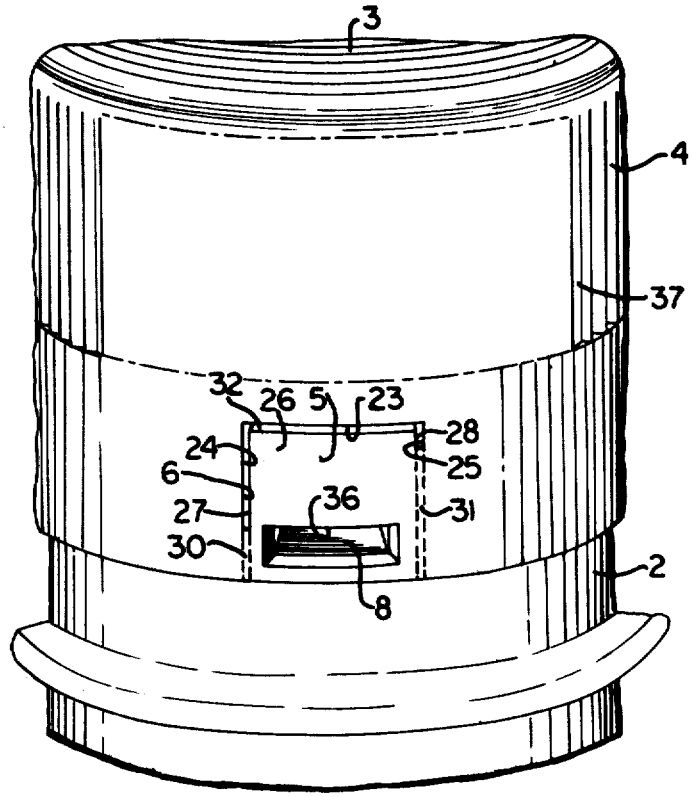
FIG. 4 is a fragmentary perspective view on a reduced scale showing the cap in sealing position on the container.
Figure 5:
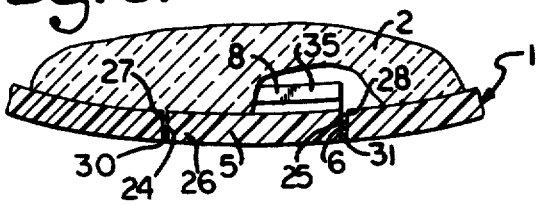
FIG. 5 is a fragmentary cross-sectional view of the closure cap taken along line 5—5 of FIG. 1 showing further details of the lug of the tamper tab.
Figure 6:
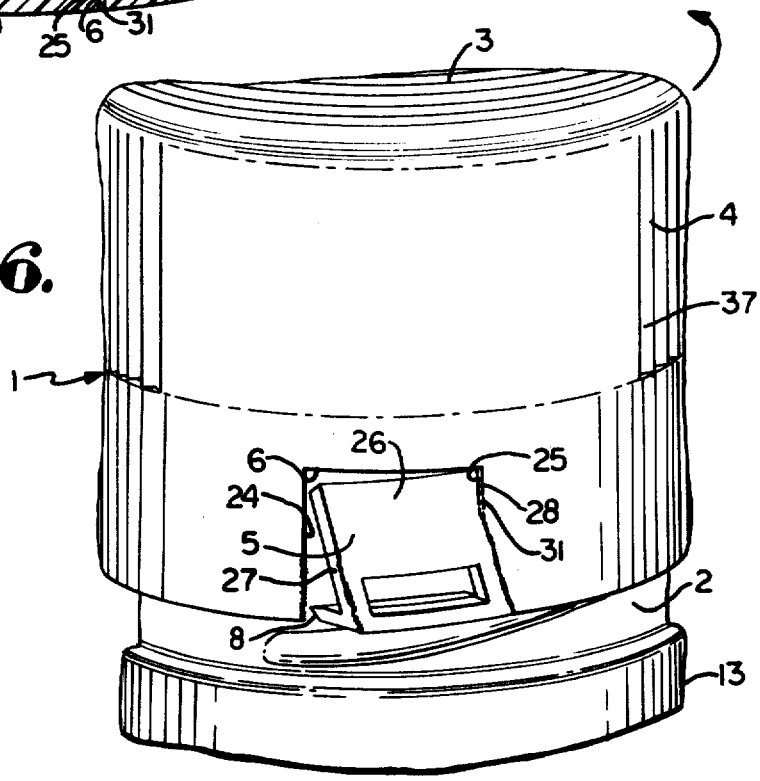
FIG. 6 is a view of the closure cap similar to FIG. 4 showing the tamper tab partially separated from the cap as a result of unscrewing the cap from the container.
Figure 7:
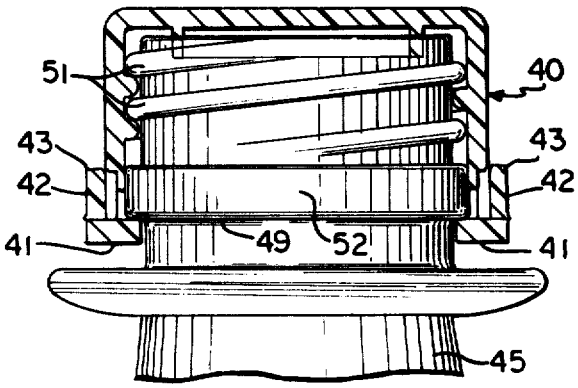
FIG. 7 is a vertical cross-sectional view of a first modification of a tamper indicating closure cap, shown in sealed installation on a container.
Figure 8:
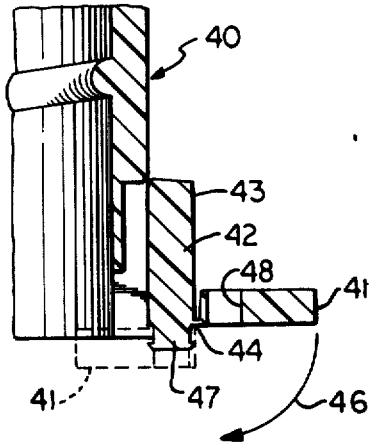
FIG. 8 is an enlarged fragmentary cross-sectional view of the first modified cap showing an outwardly projecting lug of a tamper tab as manufactured, with the inwardly projecting position of the lug shown in phantom.
Figure 9:
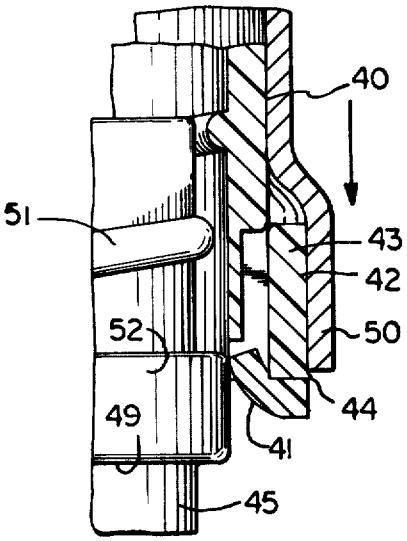
FIG. 9 is a view of the first modified cap similar to FIG. 8 showing flexure of the lug past the shoulder bead during installation of the cap on the container.
Figure 10:
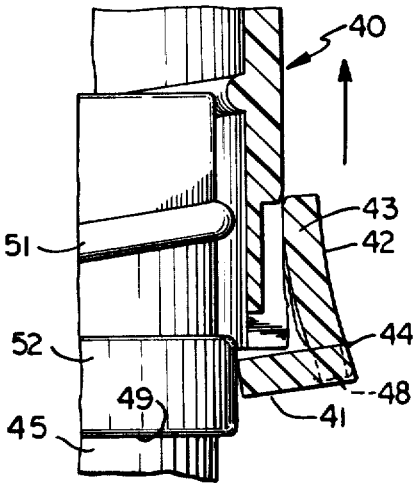
FIG. 10 is a view similar to FIG. 8 showing the tamper tab of the first modified cap being ruptured therefrom during removal of the cap from the container.

With reference to FIGS. 4, 5 and 6, the slots 6 in the skirt 4 are illustrated as substantially of an inverted square "U" shape and each is defined by a top surface 23 and opposed side surfaces 24 and 25. Each tamper tab 5 includes a tab body member 26 with a lug 8 projecting inwardly therefrom. Each tab 5 is shaped to fit within an associated slot 6 and is defined in part by opposed side edges 27 and 28. Connecting means are provided to separably connect the tab 5 with the surfaces forming the slot 6. In the illustrated embodiment, such connecting means are provided by thin bridge sections or membranes 30 and 31. The membrane 30 extends between the surface 24 of the slot 6 and the edge 27 of the tab 5, while the membrane 31 extends between the surface 25 of the slot and the edge 28 of the tab 5.

In the preferred embodiment of the present invention, the cap 1 is formed as an integral structure by molding of a resilient synthetic resin or plastic. It is foreseen that the cap 1 may also be formed of suitable metal or the like. In its simplest form, the tab body member 26 is a continuation of the skirt 4, being separated therefrom by a slit 32 (FIG. 4) extending partially around the tab body 26. Therefore, the membranes 30 and 31 are thinned or weakened bridges of material extending respectively between the side surfaces of the slot 6 and the side edges of the tab body 26.

As shown in FIG. 4, one of the membranes, for example membrane 30, is shorter than the other membrane 31. In this manner, the membrane 30 acts as a rupture membrane that is torn, broken or ruptured completely upon removal of the cap 1 from the container 2; and the membrane 31 acts as a temporary hinge membrane (FIG. 6) to retain the tab 5 with the cap 1 such that the tab 5 does not become scattered upon removal of the cap 1. The hinge membrane 31 may also be torn to remove the tab 5 if a clean exterior is desired by the user. After the tab 5 has been partially separated from the cap 1, the ruptured membrane, such as membrane 31, cannot be reconnected, so that a visual indication of the opening of the container 2 is given. However, the purchaser of the product in the container 2 may remove the partially separated tab 5 by tearing the hinge membrane 31 and discard the tab for neater and more convenient handling thereof. Upon exhaustion of the contents of the container 2, the cap 1 may be discarded and since no part of the cap 1 remains on the container 2, the container 2 may be recycled if formed of a recyclable material.

Figure 2:
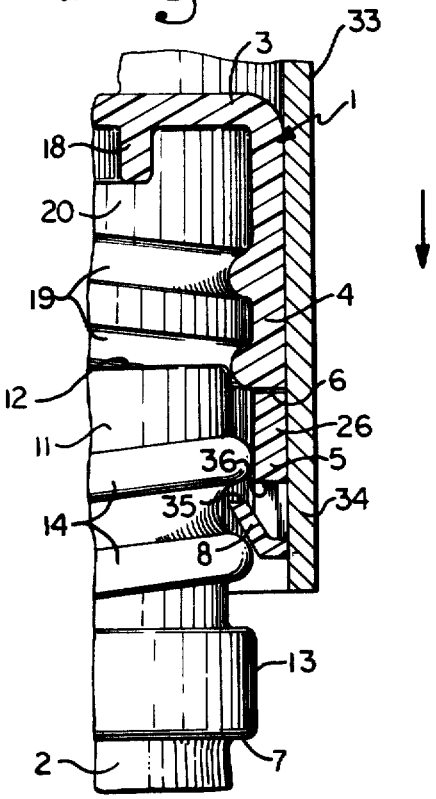
FIG. 2 is a fragmentary cross-sectional view of the closure cap shown during installation thereof on the finish end of a container.
Figure 3:
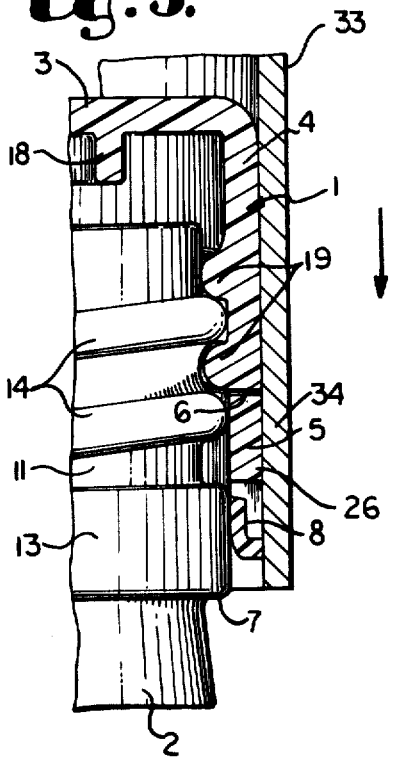
FIG. 3 is a view of the closure cap similar to FIG. 2 showing a later stage during installation of the cap on the container and showing flexure of the lug of the tamper tab to clear the bead providing the locking shoulder.

Referring to FIGS. 2 and 3 wherein is shown placement of the cap 1 on the container 2 by a bottling machine having a capping head 33, the capping head 33 employed in the capping operation should include a wall 34 which extends past the tab body 26 to prevent premature separation of the tab 5 from the cap 1 during capping. Further, the lug 8 of the tab 5 should be flexible in an upward direction to allow same to fold back so as to clear the threads 14 and bead 13 of the container 2 during capping and in this manner maintain the integrity of the cap 1. The lug 8 is illustrated as projecting inwardly and upwardly, toward the top wall 3 of the cap 1. The lug 8 includes an end surface or distal end 35 which engages the locking shoulder 7, as seen in FIG. 1, during removal of the cap 1 from the container 2. The tab body 26 may include means such as a cutout 36, see FIG. 4, to facilitate upward flexure of the lug 8 and to provide an opening during molding to allow insertion of a portion of a mold to form the upper portion of the lug 8 associated with the tab body 26. The cap 1 may be provided with means such as ribs 37 (FIGS. 4 and 6) on the external surface of the skirt 4 to facilitate gripping the cap 1 when unscrewing same from the container 2.

FIGS. 7–10 illustrate a first modified embodiment of a tamper indicating closure cap according to the present invention which is generally designated by the reference numeral 40. The principal feature of the first modified cap 40, as compared to cap 1 discussed above, is that the cap 40, as seen in FIG. 8, is manufactured so as to include tamper tabs 42 each having a lug 41 which is preformed in a position so as to project outwardly and perpendicularly relative to an associated tab 42. Such a position of the lugs 42 is easier, therefore less expensive to manufacture. In further explanation, a tab body member 43 of each tab 42 has an associated lug 41 connected thereto by an integral flexible hinge 44. Prior to or after installation of the cap 40 on a container 45, the lug 41 is folded and retained in an inwardly projecting position, as is indicated by the curved arrow 46 in FIG. 8. Means are provided to retain the lug 41 in the inwardly projecting position; and in the embodiment illustrated, the tab body 43 is provided with a plug member 47 while the lug 41 is provided with socket 48. It would be considered within the scope of this invention for the tab body member 43 to have the socket and the lug 41 to have the plug member. The plug 47 and socket 48 must be so sized that a very tight fit is obtained to prevent the lug 41 from popping loose as it engages a locking shoulder 49 of a container 45 during removal of the cap 40 from the container 45. As with the cap 1, a bottling machine capping head should include a retention wall 50 which snugly surrounds the cap 1, especially the tab body 43, and extends downwardly past the tab body 43. In addition, the lug 41 must be sufficiently flexible to clear the threads 51 and shoulder bead 52 on the container 45 during capping to prevent premature separation of the tab 52 from the cap 40. In all other respects, the cap 40 is substantially similar to the cap 1 described hereinabove.

Figure 11:
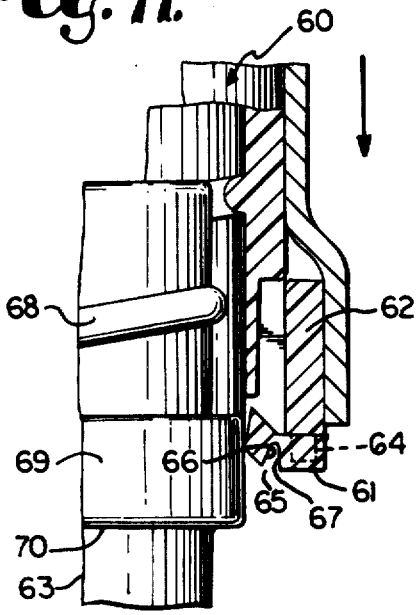
FIG. 11 is an enlarged fragmentary cross-sectional view of a second modification of a closure cap with a lug of a tamper tab thereof flexing for clearance past a shoulder bead during installation of the cap on a container.
Figure 12:
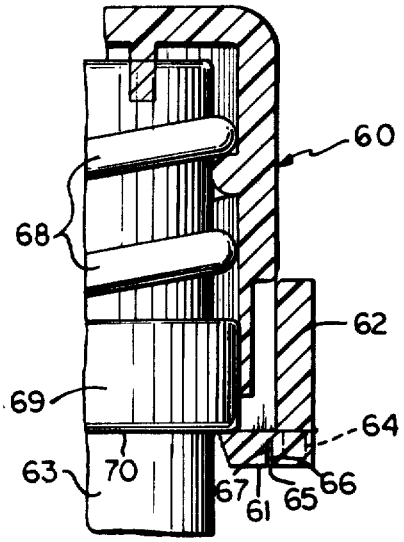
FIG. 12 is a view similar to FIG. 11 showing the second modified cap in sealed installation on the container.
Figure 13:
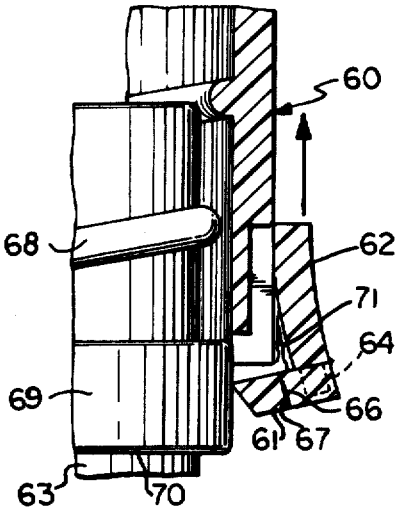
FIG. 13 is a view similar to FIG. 11 showing the tamper tab of the second modified cap being ruptured therefrom during removal of the cap from the container.

FIGS. 11-13 illustrate a second modified embodiment of a tamper indicating closure cap according to the present invention generally designated by the reference numeral 60. The second modified cap 60 is similar to the first modified cap 40 in that the cap 60 is manufactured with a lug 61 of an associated tamper tab 62 in an outwardly projecting position, and the lug 61 is folded into an inwardly projecting position and locked there prior to placement of the cap 60 on a container 63. The cap 60 is provided with a plug and socket arrangement 64 to retain the lug 61 in the inwardly projecting position, the arrangement 64 being similar to the plug 47 and socket 48 of the cap 40. The principal feature of the cap 60 is in the provision of a trough or flexure groove 65 to facilitate flexure of the lug 61 during placement of the cap 60 on the container 63. The trough 65 is defined by opposing walls 66 and 67 and extends horizontally across the lug 61. The walls 66 and 67 join near the top thereof to define a hinge. During the capping operation, the trough 65 facilitates upward flexure of the innermost portion of the lug 61 to clear threads 68 and a shoulder bead 69 of the container 63. During removal of the cap 60 from the container 63, the abutment of the walls 66 and 67 prevents downward flexure of the lug 61 during engagement of the lug 61 with a shoulder 70 of the container 63, such that the tabs 62 are at least partly separated from the cap 60 along weakened tear regions designated by the numeral 71 to indicate that the container 63 has been opened. In all other respects, the cap 60 is similar to the caps 1 and 40.

It is noted that, although a sealing ring, such as ring 18 in FIG. 1, has been shown which depends from the cap and engages an interior of a bottle, it is also possible to include sealing beads, with or without the ring, which depend from the cap and engage the top edge of the bottle to seal against leakage of carbon dioxide from carbonated beverages in such bottles.

It is foreseen that the cap according to the present invention could be molded by use of a collapsible core which would be withdrawn after the cap becomes rigid in the molding process. When using the collapsible core, the windows or cutouts, such as cutout 36 in FIG. 1, would not be necessary and the lugs, such as lug 8 in FIG. 1 could be more perpendicular to the wall of the cap rather than being turned upwardly. In addition, the cap could be molded with a non-collapsible core which would be forceably removed, preferably while a sleeve similar to the capping head 33 in FIG. 3 prevents the tab body from moving relative to the remainder of the cap to prevent breakage therebetween.

It is further foreseen that the tab could have a diagonal or other geometric shape rupture membrane which may act to fully rupture or break or alternatively act as a hinge. The tab may be made to tear or rupture from the cap wall only on one side, while being hinged on the other, or tear completely loose from the cap on opening.

While certain forms of the present invention have been described and illustrated, it is not to be limited thereto except insofar as such limitations are included in the following claims.

What is claimed and desired to secure by Letters Patent is:

1. A tamper indicating closure cap for use with a container having a mouth and a generally circumferential shoulder formed externally around a neck thereof and comprising:

(a) a top wall adapted to sealably engage the container mouth;

(b) a peripheral skirt depending from said top wall;

(c) surface means defining a slot in said skirt;

(d) a tamper tab positioned in said slot; said tab having edges and a projecting lug; said lug having an inwardly projecting position for substantially nonflexible engagement, during removal of said cap from the container, with the shoulder formed externally around the neck of the container;

(e) connecting means integrally molded between said surface means of said slot and said edges of said tab, a portion of said tab being urged outward from said skirt and said connecting means thereby being ruptured upon said lug being biased against a lower surface of the shoulder during axial rotation of said cap for removal of said cap from the container such that said tab is at least partially separated from said cap along said connecting means to indicate that the container has been opened; and (f) said lug being partially resiliently flexible in such a manner that separation of said tab from said cap during initial placement of said cap on the container is prevented.

2. A closure cap as set forth in claim 1 wherein:

(a) said peripheral skirt has threads formed on an internal surface thereof for cooperation with mating threads on the container neck to retain said cap on the container.

3. A closure cap as set forth in claim 1 wherein:

(a) said connecting means is an integral rupturable membrane extending between said tab edges and said surface means forming said slot.

4. A closure cap as set forth in claim 1 wherein:

(a) said slot is substantially an inverted "U" shape with opposed first and second side surfaces;

(b) said tab is shaped similar to said slot and has opposed first and second side edges;

(c) on said tab first side edge said connecting means is an integral flexible hinge extending between said slot first side surface and said tab first side edge; and (d) on said tab second side edge said connecting means is an integral rupture membrane extending between said slot second side surface and said tab second side edge.

5. A closure cap as set forth in claim 1 wherein:

(a) said lug projects inwardly and upwardly in a direction toward said top wall of said cap.

6. A closure cap as set forth in claim 1 wherein:

(a) said slot is formed on each of diametrically opposite sides of said peripheral skirt; and (b) each slot has said tamper tab separably positioned therein.

7. A closure cap as set forth in claim 1 including:
(a) sealing means comprising an annular projection extending downwardly from said top wall of said cap for sealing engagement with an inner cylindrical surface of the container.

8. In combination:
(a) a container having a neck and a mouth with a circumferential shoulder formed externally around said neck;
(b) a closure cap having a closure position relative to said container; said cap comprising: p2 (1) a top wall sealably engaging the container mouth when said cap is in said closure position;
(2) a peripheral skirt depending from said top wall and encircling an external portion of said container neck;
(3) surface means defining a slot in said skirt;
(4) a tamper tab postioned in said slot; said tab having edges and a projecting lug; said lug having an inwardly projecting position for substantially non-flexible engagement, during removal of said cap from said container, with said shoulder;
(5) connecting means between said surface means of said slot and said edges of said tab, said connecting means being rupturable upon said lug being biased against said shoulder during removal of said cap from said container such that said tab is at least partially separated from said cap to indicate that said container has been opened; and
(c) capping means including a wall for closely surrounding said cap tamper tab during placement of said cap on said container to prevent said tamper tab from being biased outwardly by engagement of said lug with said shoulder; said capping means wall being selectively removable from surrounding relationship relative to said tamper tab when said cap is in the closure position thereof.

9. A tamper indicating closure cap for use with a container having a mouth and a shoulder formed externally around a neck thereof and comprising:
(a) a top wall adapted to sealably engage the container mouth;
(b) a peripheral skirt depending from said top wall;
(c) surface means defining a slot in said skirt;
(d) a tamper tab positioned in said slot; said tab having a tab body with edges, and a projecting lug; said lug being connected to said tab body by an integral hinge; said cap being formed with said lug projecting substantially outwardly of said peripheral skirt and said lug being folded into an inwardly projecting position for substantially non-flexible engagement during removal of said cap from the container with the shoulder of said container; said tab includes;
(e) cooperating means on said tab body and said lug fixedly positioning said lug in said inwardly projecting position;
(f) connecting means between said surface means of said slot and said edges of said tab, said connecting means being rupturable upon said lug being biased against the shoulder during removal of said cap from the container such that said tab is at least partially separated from said cap to indicate that the container has been opened; and
(g) said lug being partially resiliently flexible in such a manner that separation of said tab from said cap during placement of said cap on the container is prevented.

10. A closure cap as set forth in claim 9 wherein said cooperating means includes:
(a) a plug member on one of said tab body and said lug; and
(b) a socket snugly receiving said plug member on the other of said tab body and said lug.

11. A closure cap as set forth in claim 9 including:
(a) trough means extending across said lug to facilitate flexure thereof during placement of said cap on said container.

12. A closure cap as set forth in claim 11 wherein:
(a) said lug includes a hinge above said trough means; and
(b) said trough means is partially defined by a pair of opposed surfaces positioned for mutual abutment to prevent flexure of said lug upon engagement thereof with the container shoulder during removal of said cap from the container; said surfaces separating upon flexure of said hinge during placement of said cap on the container.

13. In combination:
(a) a container having a neck opening at a mouth and having a shoulder located on the exterior of said neck spaced from said mouth; and
(b) a tamper indicating closure cap; said cap sealably closing said mouth when placed on said container and comprising:
(1) a top wall adapted to sealably engage the container mouth;
(2) a peripheral skirt depending from said top wall;
(3) surface means defining a slot in said skirt;
(4) a tamper tab positioned in said slot; said tab having edges and a projecting lug; said lug having an inwardly projecting position for substantially non-flexible engagement, during removal of said cap from the container, with the shoulder formed externally around the neck of the container;
(5) connecting means between said surface means of said slot and said edges of said tab, said connecting means being rupturable upon said lug being biased against the shoulder during removal of said cap from the container such that said tab is at least partially separated from said cap to indicate that the container has been opened;
(6) said lug being partially resiliently flexible in such a manner that separation of said tab from said cap during placement of said cap on the container is prevented; and
(7) said lug, when in the inwardly projecting position thereof, includes a distal end; said distal end being upwardly flexible to pass over said container shoulder when said cap is placed on said container; and said distal end being substantially downwardly inflexible such that, when said cap is removed from said container, said lug distal end engages said shoulder in an inflexible manner thereby biasing said tab outwardly and rupturing said connecting means.

14. In combination:
(a) a container having a neck and a mouth with a circumferential shoulder formed externally around said neck; and
(b) a closure cap having a closure position relative to said container; said cap comprising:

(1) a top wall sealably engaging the container mouth when said cap is in said closure position;

(2) a peripheral skirt depending from said top wall and encircling an external portion of said container neck;

(3) surface means defining a slot in said skirt;

(4) a tamper tab positioned in said slot; said tab having edges generally perpendicular to said shoulder when said cap is in said closure position; said tab also having a projecting lug; said lug having an inwardly projecting position when said cap is in said closure position for substantially nonflexible engagement, during axial rotation of said cap for removal of said cap from said container, with said shoulder; said lug being flexible away from said shoulder during placement of said cap on said container; and (5) connecting means integrally molded between said surface means of said slot and said edges of said tab, said connecting means being rupturable upon said lug being biased against said shoulder during axial rotation of said cap for removal of said cap from said container such that said tab is at least partially separated from said cap to indicate that said container has been opened.

* * * * *